United States Patent [19]

Hagelberg et al.

[11] 4,215,630

[45] Aug. 5, 1980

[54] ANTI-SHIP TORPEDO DEFENSE MISSILE

[75] Inventors: Allen C. Hagelberg, Diamond Bar; Walter A. Lobitz, Westwood, both of Calif.

[73] Assignee: General Dynamics Corporation Pomona Division, Pomona, Calif.

[21] Appl. No.: 883,620

[22] Filed: Mar. 6, 1978

[51] Int. Cl.[3] ..... F42B 22/04

[52] U.S. Cl. ..... 102/10; 89/1 A

[58] Field of Search ..... 102/18 R, 14, 13, 10, 102/211, 215; 89/36 AE, 1 A; 114/240 R, 240 A, 240 D

[56] References Cited

U.S. PATENT DOCUMENTS

| | | | |
|---|---|---|---|
| 1,195,042 | 8/1916 | Leon | 89/1 A |
| 2,513,279 | 7/1950 | Bradley | 89/1 A |
| 3,875,844 | 4/1975 | Hicks | 89/1 A |
| 3,943,870 | 3/1976 | Paslay | 89/36 AE |

FOREIGN PATENT DOCUMENTS

| | | | |
|---|---|---|---|
| 100691 | 6/1916 | United Kingdom | 114/240 R |

*Primary Examiner*—Charles T. Jordan

*Attorney, Agent, or Firm*—Neil F. Martin; Freling E. Baker; Edward B. Johnson

[57] ABSTRACT

A ship anti-torpedo defense system includes a detecting device for detecting and locating an incoming threat, such as a torpedo, and an interrelated missile launching and control system for firing at least one warhead carrying missile into the path of the oncoming threat, the missile having an active acoustic fuze system including a highly directional sensing system for continuously monitoring the position and proximity of the incoming threat and for detonating the warhead at the optimum proximity of the incoming threat with the missile. The missile floats at a predetermined depth determined by the predetermined depth of the torpedo to be intercepted.

15 Claims, 9 Drawing Figures

ANTI-SHIP TORPEDO DEFENSE MISSILE

BACKGROUND OF THE INVENTION

The present invention relates to defensive weapons and pertains particularly to an anti-ship torpedo defense missile system for intercepting and destroying incoming torpedos.

Continued improvement in weapon systems, both in offensive and defensive types, are essential in order for a nation to maintain its security against potential invaders. One of the most critical defense systems essential to this security is that of the interception and destruction of torpedos launched at ocean going vessels, both of the commercial and military type.

The speed and sophistication of currently available torpedos make many of the prior art anti-torpedo systems obsolete. Many of todays torpedos are capable of high speed evasive maneuvering to avoid anti-torpedo systems.

The prior art anti-torpedo systems are exemplified in the following patents:

British Specification Pat. No. 100,691, issued June 13, 1916 to Demetrio Maggiora. This patent discloses a method of protecting ships and apparatus for use therein which consists of creating by simultaneously discharging a large number of projectiles in a zone of disturbance around a ship on one side or on all sides as soon as attack is signaled by a ship. In order to create this zone, use is made of percussion of fuze projectiles, the exploding of which is adjusted to a predetermined distance and are thrown at different ranges outward from the vessel being protected. The theory of the method is that any torpedo entering the zone of disturbance is destroyed or caused to deviate and cannot reach the ship.

U.S. Pat. No. 1,195,042, issued Aug. 15, 1916 to Leon is directed to means for preventing attacks of torpedos or the like. The patent is directed to means for preventing attacks of torpedos or the like and is somewhat similar to the previously described British disclosure and consists essentially of placing explosives, such as by means of tubes or guns in the path of the oncoming torpedo. The ejection of the explosive agent is determined automatically by a sound receiver or telephonic receiver carried by the ship. The telephone receivers are connected with the discharging mechanism of the torpedo tubes for automatically discharging the torpedos upon receiving sound through the receiver.

U.S. Pat. No. 3,875,844, issued Apr. 8, 1975 to Hicks and directed to an anti-torpedo system. This patent discloses an embodiment wherein the presence of oncoming torpedos is made manifest by change of antenna current of the radial frequency transmitting system in which a reference line comprises an antenna which is arranged within the water a predetermined distance from the vessel and parallel thereto. This change in antenna current causes one or more of a plurality of guns, mortars or other launching apparatus on the vessel to fire missiles having an explosive charge therein into the water just inside the reference line and in the direction from which the torpedo is approaching when the torpedo has arrived at a predetermined distance from the vessel. The explosion of the missiles discharged from the vessel are expected to thus hit and destroy or at least disable the torpedo.

U.S. Pat. No. 3,943,870, issued Mar. 16, 1976 to Paslay, is directed to a pinging control anti-torpedo device.

In this patent the system disclosed includes a plurality of rocket launchers, each of which includes three launching tubes for laying out a pattern of anti-torpedo rockets. The tubes of each rocket launcher are arranged in a fan-like manner such that rockets when simultaneously projected from the tubes and exploded within the water set up patterns at a predetermined distance from the vessel, such as 175 feet in spaced relationship. The explosive pattern for the launching tubes provide destructive zones set up for intercepting and destroying incoming torpedos. The launchers selectively project the rockets in accordance with signals received from the oncoming torpedo indicative of the speed for the firing thereof to intercept the torpedo.

While many anti-torpedo weapon systems are available and others have been proposed, a great deal of room for improvement exists in such systems. It is desirable, for example, that the accuracy and efficiency of such systems be improved. It is also desirable that the costs of such systems be greatly reduced.

SUMMARY AND OBJECTS OF THE INVENTION

It is accordingly the primary object of the present invention to overcome the above problems of the prior art.

Another object of the present invention is to provide an improved anti-torpedo weapon system.

A further object of the present invention is to provide a weapon system that is highly accurate and effective in the defense of a ship against torpedos.

Still another object of the invention is to provide a highly effective and accurate anti-torpedo system that is relatively inexpensive to construct and operate.

In accordance with the primary aspect of the present invention, an anti-torpedo weapon system for defending a ship against torpedos or the like, and includes a detecting system for detecting and locating incoming threats and a missile firing and control system for deploying one or more missiles into the path of the incoming threat, with means aboard the missile for continuously monitoring the incoming threat from directional sensing means associated with the missile and for controllably firing the warhead of the missile at the optimum proximity of the incoming threat.

BRIEF DESCRIPTION OF THE DRAWING

The above and other objects and advantages of the present invention will become apparent from the following description when read in conjunction with the drawings, wherein.

DETAILED DESCRIPTION OF A PREFERRED EMBODIMENT

Figure 1:
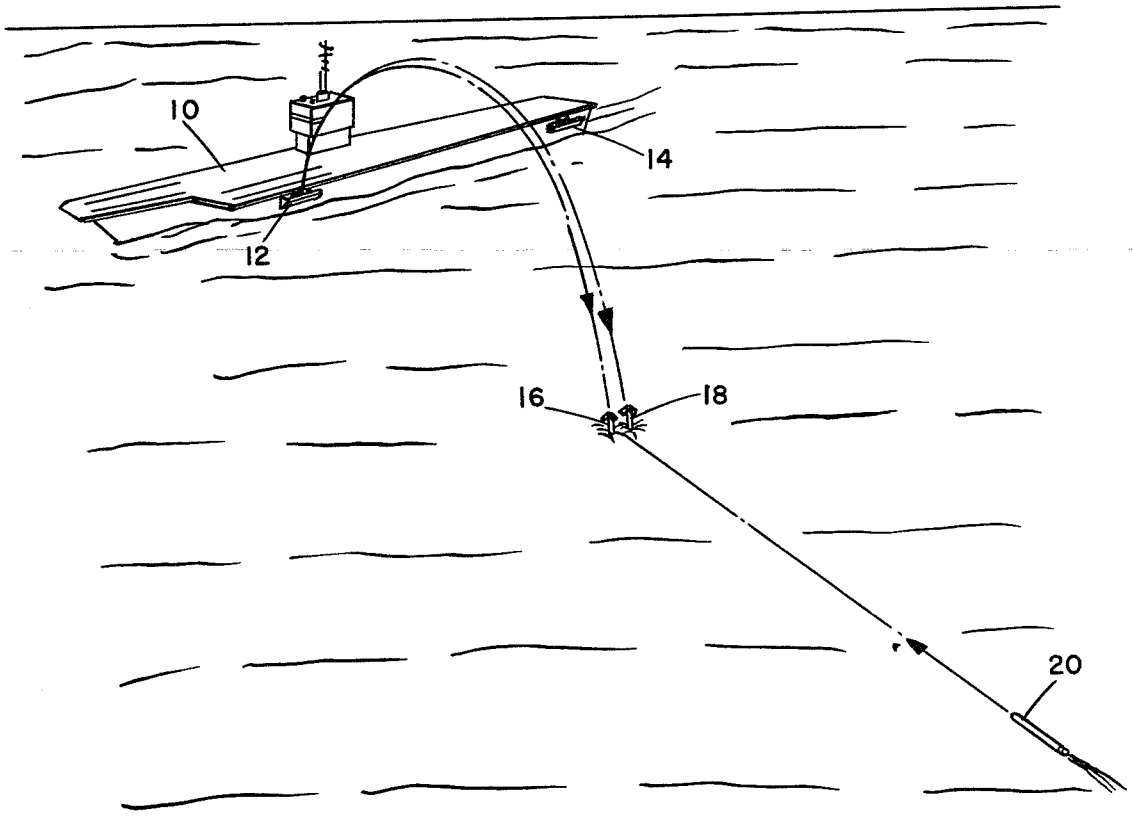
FIG. 1 is a perspective view of an ocean going vessel utilizing the system of the present invention in defense against an incoming torpedo.

Turning to FIG. 1 of the drawings, there is illustrated a ship 10, such as an aircraft carrier or the like, employing a system in accordance with the present invention utilizing one or more batteries of defensive missiles 12 and 14, for deploying a plurality of missiles 16 and 18 in the path of an oncoming torpedo 20 for defense thereagainst. In general the system is designed to detect and locate the position of an incoming threat such as a torpedo and then deploy a number of warhead carrying missiles into the predicted path of the incoming torpedo, with control means adapted to continuously monitor the location and progression of the incoming torpedo and detonate the warhead at the optimal proximity of the torpedo. The system is designed to be effective against any type of torpedo, such as the straight running, pattern running, acoustic homing or wake homing type. The warhead carried by the missile is sized to provide effective lethality against these type torpedos.

The missiles are buoyant and are designed to be deployed to a predetermined depth D, calculated to be the running depth of the torpedo. This depth can be controlled by a system in the missile itself, including a flotation jacket 22, which is designed to be controllably inflated from a suitable source of compressed gas aboard the missile.

The missiles, as illustrated, are disposed a predetermined distance S apart so that the torpedo passing therebetween will be within the lethal sphere of the warhead or explosive charge carried by at least one of the missiles. The warhead closest in proximity to the passing torpedo will detonate to knock out the torpedo. With the present system a missile or anti-torpedo rocket will be placed within a position such that the torpedo will pass within the lethal radius of the warhead carried by the rocket.

Figure 2:
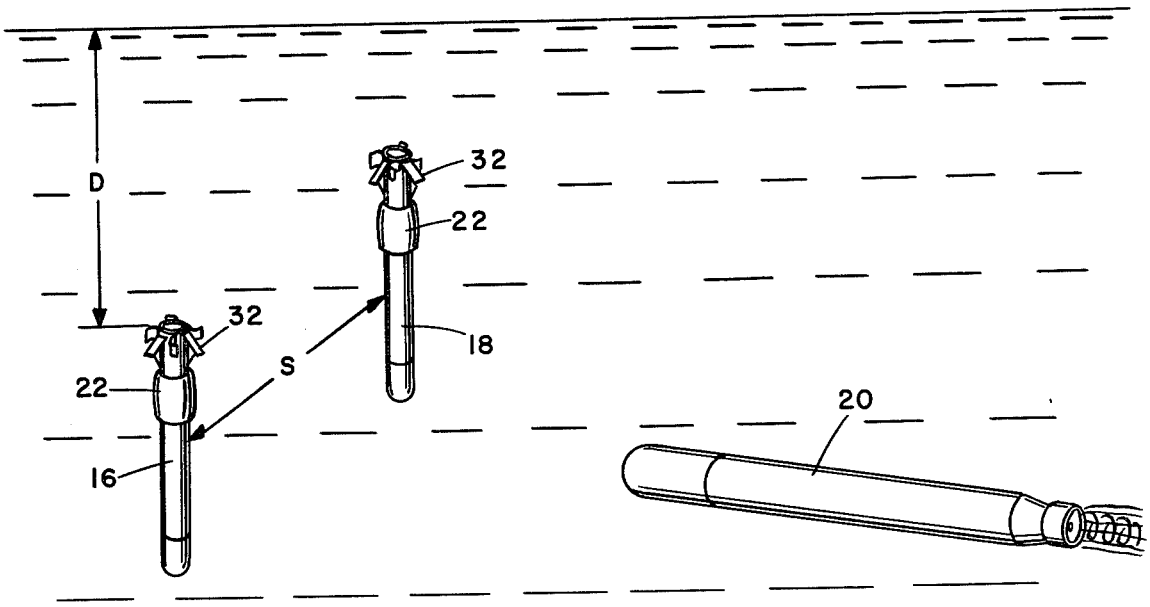
FIG. 2 is an enlarged view of a portion of FIG. 1, showing the interception of a torpedo by a pair of missiles.
Figure 3:
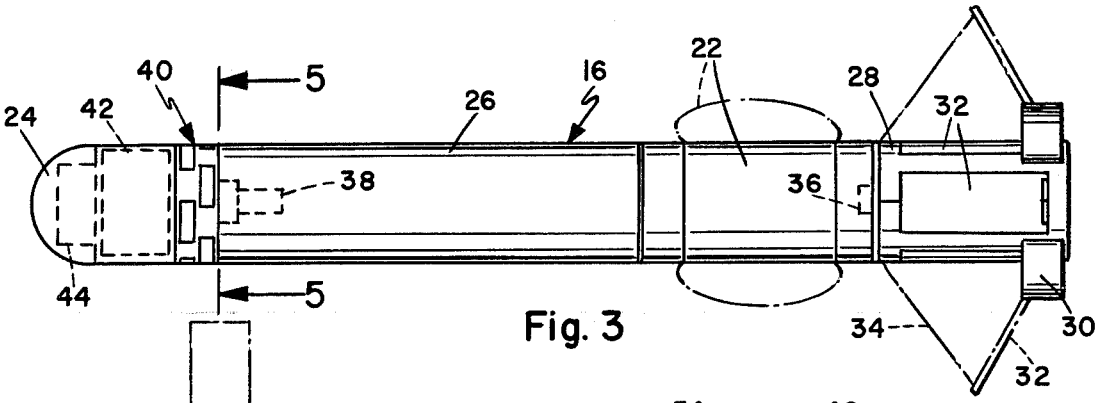
FIG. 3 is a side elevational view of a missile in accordance with the present invention.
Figure 4:
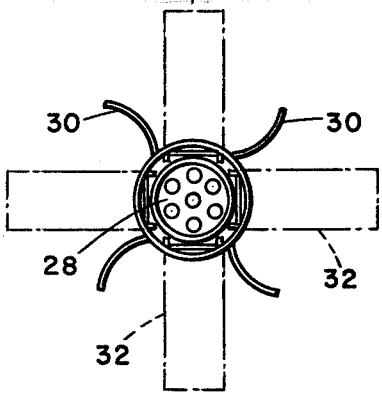
FIG. 4 is an end view of the missile of FIG. 3.

The missiles, as shown in FIG. 2, are vertically positioned and stabilized in the vertical position and at a predetermined depth to intercept the torpedo. Each missile includes an active underwater fuze device to be described below. As best seen in FIG. 3, a missile 16 includes an elongated cylindrical body having an aerodynamically configured nose portion 24 in which the fuze section is housed, a center warhead or explosive section 26, and a propulsion section 28 at the rear end thereof. Also at the rear propulsion section are a plurality of stabilizer fins 30 and brake fins 32. The stabilizer fins stabilize the rocket or missile during flight and upon impact with the water, the brake fins 32 are extended to decelerate or brake the rocket and stop it in the water. The brake fins 32 are preferably connected at the forward end with cables at 34 connecting the forward end of the brake fin to the body of the rocket. The float collar is controlled for controlling the depth of the rocket by means of a pressure regulator 36 which controls the inflation of the collar 22. This pressure regulator operates to measure or meter a pressurized source of gas, such as from a bottle of compressed gas, into the float collar for stabilizing the rockets at selected depths.

The warhead section of the rocket should be sufficiently large to contain the necessary explosives to knock out the expected threat. This section may be a single large explosive or may contain a plurality of directional charges.

A combined arming, disarming and exploder device 38 automatically arms the warhead upon impact of the missile with the water and includes exploder means for detonating the warhead upon a predetermined command from the computer. This safe/arm-exploder may be a conventional electro-mechanical device operated by the aboard computer as in the illustrated system, or by remote control.

The missile includes an active fuze system which includes a ultrasonic sensing system 40 included in the overall system which comprises eight transducers which are radially directed around the circumference of the rockets. Each transducer covers a separate segment of about 45° (conically shaped) of the 360° of a circle and the unique control system of the present system selects a transducer in a predetermined direction, thus providing a highly directional sensing device. The system is pre-programmed such that the transducer oriented in the direction of the threat is activated after the missile is stabilized, thus sensing the direction of the threat. The system includes a pulse doppler system to also determine the speed and range of the threat. The transducers are mounted as seen, for example, in FIGS. 3 and 5 in two layers of four each with each oriented in a different direction. This provides essentially 360° radius of coverage ability around the vertically positioned and stabilized rocket in its position in the water. This arrangement provides a directional field of view feature since the transducers are interconnected with a microcomputer situated within the nose cone of fuze section of the rocket for selective activation. A fuze control section 42 is enclosed within the nose cone section 24 and includes a microcomputer or microprocessor and other circuitry powered by a battery 44. This entire arrangement provides an active directional underwater fuze device in the form of an echo ranging system, which continuously and actively monitors the threat and fires the munitions warheads when the target is within the lethal radius. A pulse doppler system functions to continuously measure the target range and range rate. This information regarding the target range and rate is processed in a microcomputer algorithm to generate a fire decision at the optimum time.

The directional field of view feature of this fuze section enhances the operation of the weapon. The expected target azimuth angle from the launching ship is stored in the fuze microcomputer in the rocket and is used to select one of several directional transducers in the transducer section 40 which interrogates the target. The directionality of the sensing means provides several benefits including a lower active power level requirement due to the reduced field of view and reduced processing requirements due to the narrowed field of view.

Significant important aspects of this invention are the novel directional field of view feature, the microcomputer fuze signal processing, and the weapon vertically positioned and stabilized, which permits a bearing reference back to the control solution. The weapon (i.e. missile) is a self-contained system that functions to perform its mission completely alone once deployed. It requires no further support.

Figure 5:
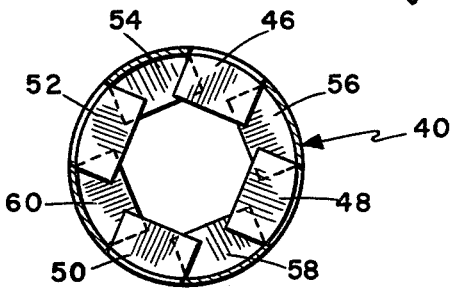
FIG. 5 is a view taken on lines 5—5 of FIG. 3.
Figure 6:
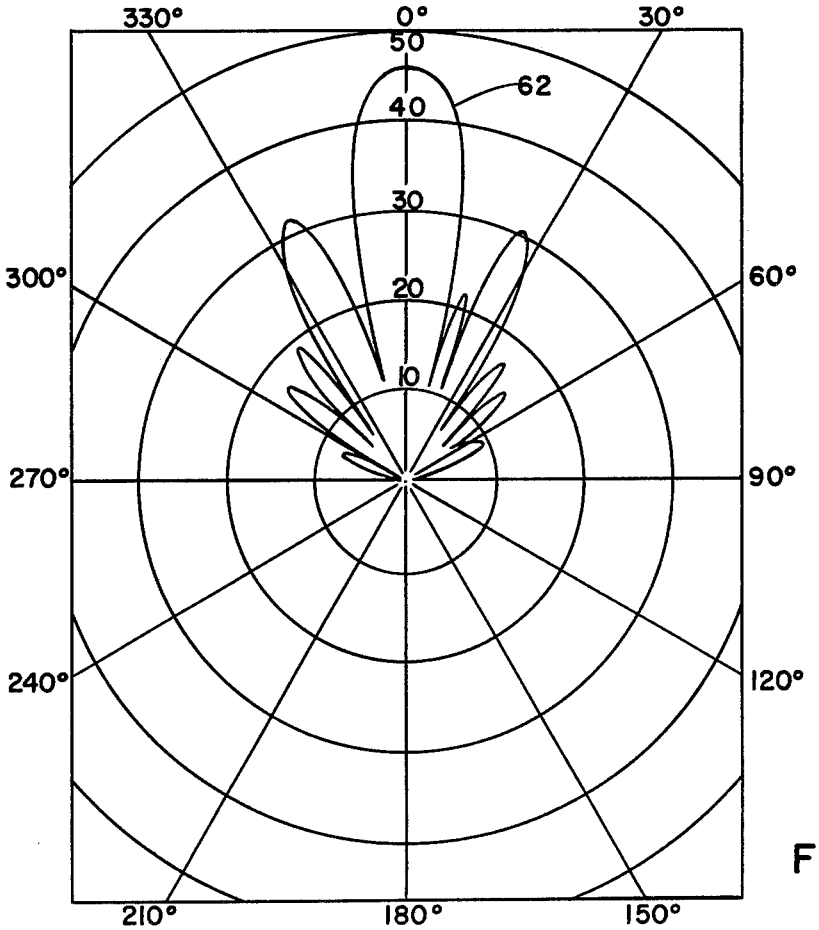
FIG. 6 is a diagrammatic illustration of directional pattern of the missile carrying sensing means.

As shown in FIG. 5, the transducer section 40 includes an upper group of radially directed transducers, 46, 48, 50, and 52, all in one plane across the axis of the rocket and a second group of transducers 54, 56, 58 and 60 in a second plane slightly below the first plane. These radially directed transducers provide a highly directional sensing system with a field of view capability such as shown in FIG. 6.

All of the above described components in the nose cone of the system comprises basically the fuze section of the rocket. The fuze system includes in effect an acoustic active directional pulse doppler echo ranging system operating in an ultrasonic frequency band. The sensing system is highly directional, as shown for example in FIG. 6, in that it will cover primarily a selected segment as indicated by the lobe 62. Thus, the necessity of discriminating against other directional interferences is eliminated. The acoustic feature gives a larger range of detection in excess of 100 feet for ample processing of the firing command. A firing command for detonation of the warhead is given when the threat, such as a torpedo, has entered the lethal radius and has reached an optimum firing position within that radius. The fuze for the illustrated example, generates a firing command when a sixty foot sphere has been penetrated and either the closest point of approach or a radial distance of less than twenty feet has been reached. The fuze functions under all environmental conditions with a high probability of firing calculated to be greater than 0.95, with a probability of false alarm of less than 0.01.

Figure 7:
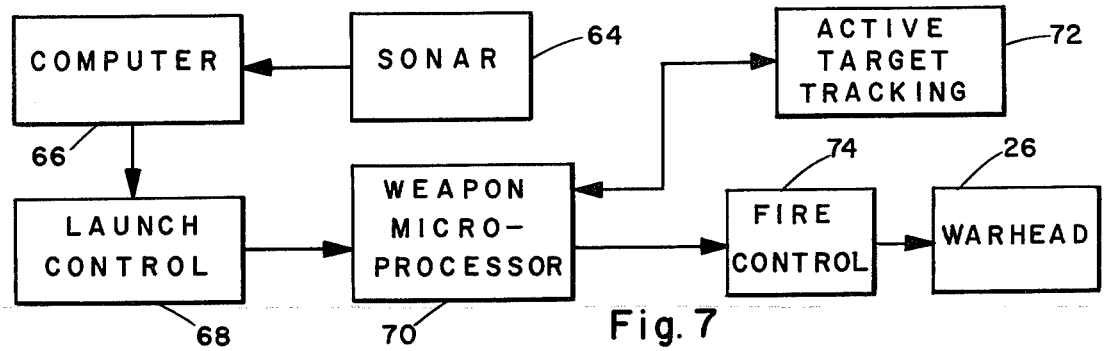
FIG. 7 is a basic block diagram of the system.

Turning to FIG. 7 of the drawing, there is illustrated a system diagram of the overall weapon system of the invention. The basic components of the overall system comprise a sonar detecting means 64 for detecting and locating an incoming threat, such as a torpedo or the like. The information picked up by this sonar, which includes distance, speed, azimuth, and other location information, is fed into a launch control computer 66 which assesses the information and, if a threat is detected, the information is fed through a launch control system 68 which launches a missile. The launch and fire control system azimuth and location of the threat is fed into the weapon fuze microcomputer, which is aboard the missile and identified by the numeral 70, which controls the active target tracking means 72 for actively tracking the target. The fuze microcomputer is connected to control the fire control system 74 within the missile and which is active to fire the warhead 26. This system is effective to detect, locate an incoming threat and process the necessary information, feeding the necessary information into the fuze microcomputer which after the weapon is launched and placed in position ahead of the oncoming threat, activates the fire control system aboard the missile for activating and detonating the warhead. The fuze microcomputer is a general purpose, stored program, 8-bit machine based upon a MOS microprocessor device. A suitable microprocessor is available from Intel, Corp. as No. 8085 and is provided with memory PROMS.

Figure 8:
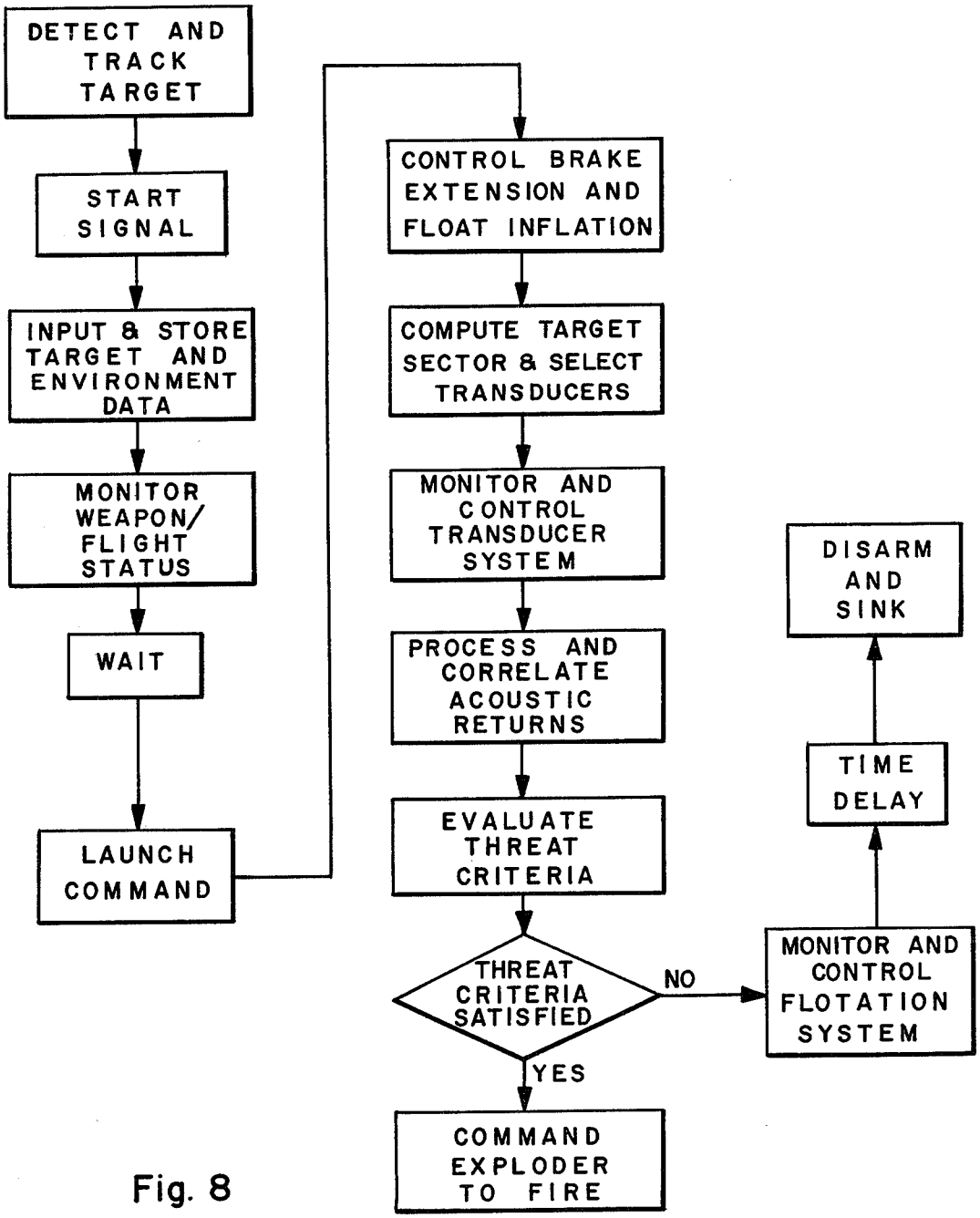
FIG. 8 is a functional diagram of the system.

A fuze system functional diagram is illustrated in FIG. 8, wherein the functions of the overall system are set forth. The system first detects and tracks a target and thereby obtains target characteristics, such as target depth, track angle, track speed, intercept time, which are stored in the weapon computer memory. The serial operation of the fuze control algorithm is shown in FIG. 8. This serial operation includes the steps of detect and track target, start signal, input and storage of target and environmental data. Before the weapon is launched, target characteristics such as the target depth, track angle, track speed and intercept time are stored in the weapon computer memory along with other target and environmental data. The system then continues to monitor the round and flight status and after the data storage, the weapon computer will enter a wait state until the round launch command appears or new data is transferred. The target information, together with the command signal, such as channel frequency and brake and float activation time, allow the weapon microcomputer to control the missile operation.

After the missile launch command appears, the weapon computer will start the fuze operation algorithm. This will include the control of brake fin extension and float inflation as the first commands which brakes the speed of the rocket which has been fired by trajectory and selects or controls the float inflation to position the round at the preselected depth.

As soon as the missile or rocket is in a stable position, the appropriate target tracking sector will be calculated from prior data entry and a directional sensor aboard the weapon. This will include computing the target sector and selecting the transducers for that sector. The stored target track angle will be compared to the missile magnetic compass sensor to determine which hydrophone sector to activate. Next, the ship command operating channel frequency will be activated by the computer and the step of monitor and control of the transducer system will begin. Short duration pulses of approximately 2.0 milliseconds will be generated by the pulse generator and used to modulate the carrier signal. A power amplifier will raise the level to 500 watts peak pulse power. Matching the low output impedance of the power amplifier to the high input impedance to the transducer will be done by means of a step up transformer. The transducer selector switch will route the illumination signal to the selected transducer to monitor the appropriate sector. Acoustic energy will be projected in the direction of the target and the computer control of the selected section will be continuously maintained to accommodate roll motion of the round. The system will then continue to process and correlate acoustic returns from the target. Immediately following the illumination pulse, the receiver section will be activated. The return echo signals are amplified and bypass filtered to enhance the signal to noise ratio and eliminate adjacent signal interference. The system will evaluate the threat criteria and if the criteria of a threat is not satisfied, the system will continue to monitor and control the flotation system for a predetermined period of time. If after a predetermined period of time no threat appears within the lethal radius of the missile, it will disarm the exploder device, deactivate the flotation control and sink to the bottom of the ocean. If the threat criteria is satisfied, a command will be issued to the exploder to fire the warhead upon the approach of the threat within the lethal envelope.

Figure 9:
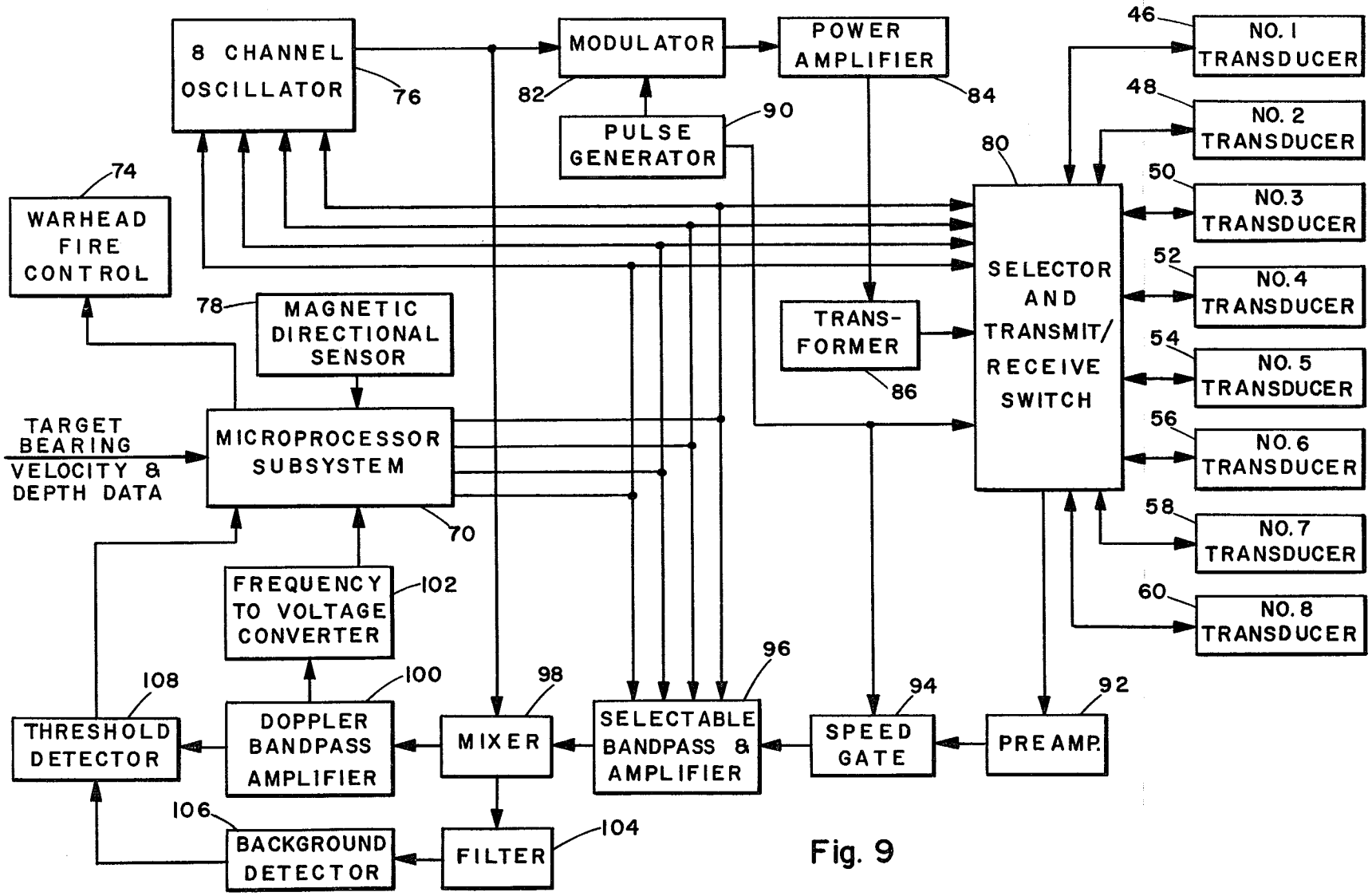
FIG. 9 is a block diagram of the control system in the missile.

The control system carried within the rocket itself is schematically illustrated in FIG. 9. This system is an acoustic active directional pulse doppler echo ranging system operating in an ultrasonic frequency band. The system functions to fire the warhead when the target has both entered the lethal radius and reached an optimum firing position. This system comprising an acoustic echo ranging system was chosen over other systems such as magnetic anomaly, electromagnetic, radio frequency, and optical systems primarily because of its extended detection range capability. Only acoustic systems were found to have reliable performances at a distance in excess of 100 feet, which provides the required time for processing the information.

The proposed system operates at an active echo ranging system with active operation chosen to provide consistent performance for all target types independent of target size and noise emission levels. Active operation also provides independent stand alone fuzing, requiring no ship support or adjacent fuze cooperation.

The system comprises a microprocessor sub-system 70 which receives target bearing and velocity data information from the sonar computer and launch control system of the basic system mounted in the ship. The microprocessor sub-system also receives an orientation signal from magnetic directional sensor 78 after the rocket is stabilized. The microprocessor then properly selects the transducer oriented to track the threat. The microprocessor 70 is connected through a selector and transmit/receive selector switch 80 to the transducers 46, 48, 50, 52, 54, 56, 58 and 60 and through an eight channel oscillator 76. The oscillator is connected through a modulator 82 and power amplifier 84 to a transformer 86, which is connected to the selector and transmit/receive switch 80. A pulse generator 90 is connected to the modulator 82 and to the selector and transmit/receive switch 80. This switch 80 functions to select a transducer 46, 48, 50, 52, 54, 56, 58 and 60 and to alternately transmit a signal pulse from generator 90 to the selected transducer and receive a signal therefrom. The fuze system operates basically as an echo ranging system. Short duration, high power, ultrasonic pulses of acoustic energy are projected by the selected transducer in the direction of the target path illuminating the target with acoustic energy. These signal pulses are generated with pulse generator 90 and are amplified and modulated in modulator 82 and amplified in the power amplifier 84 and converted in the transformer 86 and transmitted through the selector and transmit switch, which is controlled by the microprocessor 70. Following the illumination of the target, the receiver is activated to receive energy reflected from the target. The step up transformer 86 will match the low output impedance of the power amplifier 84 to the impedance of the transducer 46, 48, 50, 52, 54, 56, 58 and 60 selected. The transducer selector switch will route the elimination signal to the selected transducer. An acoustic energy pulse will be projected in the direction of the target, and computer control of the selected sector will be continuously maintained to accommodate roll motion of the round.

Immediately following the illumination pulse the receiver section will be activated. A return echo signal received in the transducers is amplified by a pre-amp 92 and passed through speed gate 94 and then pass filtered in a band pass filter 96 to enhance the signal to noise ratio and eliminate the adjacent channel interference. The filtered echo signals are then mixed in mixer 98 with the carrier oscillator signal to generate the doppler difference frequency. The doppler signals are processed through two channels, the frequency channel, which carries range rate information, and the time channel which carries range information. The frequency channel includes a doppler band pass amplifier 100 through which the signal is passed and amplified, and then through a frequency-to-voltage converter 102 which converts the frequency to an equivalent binary word for the microcomputer 70. The time channel includes a filter 104, background detector 106, and threshold detector 108, which function to generate time of arrival data for the microcomputer, which is conditioned by a constant false alarm rate detector.

Target tracking processing will begin when time of arrival data appears at the microcomputer input. The predicted target track speed stored in the microcomputer memory will be used in the processing algorithm to gate the echo return doppler limit. Echo returns from stationary or slow moving reflections will be weeded out by this system. The predicted target intercept time will be used in the processing algorithm to gate out false alarms in the time period from round activation to initial target engagement. When the target threat criteria has been satisfied, a warhead fire pulse is generated by the microprocessor commanding the warhead fire control 74 to detonate the warhead.

The fire logic sub-system which is located in the microprocessor utilizes the information contained in the received pulse series to make the fire decision. The extensive processing of these data insures a better quality decision. This extended processing capability requires adequate memory within the microcomputer. The microcomputer offers substantial performance increase over other systems such as dedicated logic, due to the ability of the microcomputer to calculate equations and adjust fuze operations based on presently existing conditions. The ability to call sub-routines and perform stored algorithms which apply to various threat situations increase the operational capability of the system many times over dedicated logic processing.

The proposed transducer will consist of three elements aligned to cover the projected beam pattern when driven in phase. The proposed horizontal beam width will be about 50°.

The weapon system described above provides a concept which consists of a stabilized launch, ballistic delivery, neutrally buoyant stationary warhead accurately placed in the path of oncoming threats, such as torpedos. The warhead is sized to provide effective lethality against either the straight or pattern running threat and against either the acoustic or wake homing threat. The engagement system accepts launcher, azimuth and elevation pointing orders, target velocity and bearing and depth order data from a fire control system and provides required round selection and initialization functions. The launcher provides a local motion decoupling and initiates the air delivery function on command. The launcher includes an on-line monitor system providing real-time system status feedback to a fire control or central monitor system. The missile after being launched follows a ballistic trajectory to the point of water entry. At water entry hydrodynamic brakes are deployed and the final warhead arming interlocks are closed by the deceleration. The missile is stabilized by active flotation in vertical orientation at a selected point consistent with torpedo class running depth.

The active acoustic target detection system of the missile provides a target sense in track function sensing and tracking the target. The target is allowed to close within the warhead lethal envelope before detonation occurs. The system provides discrimination between its own ships, adjacent rounds, and parallel paths salvo torpedos. The weapon with its acoustic fuze and microcomputer control can be programmed to act as a decoy against acoustic homing torpedos. The acoustic transducer can be driven to make up the ship noise for passive torpedos and/or receive active acoustic torpedo ping, signal process (e.g. doppler downshift) and return the decoy signal to the acoustic torpedo. The system can also be adapted to handle fuze counter measure problems and can be made to fuze on a torpedo JAM signal.

While the present invention has been illustrated and described by means of a specific embodiment, it is to be understood that numerous changes and modifications may be made therein without departing from the spirit and scope of the invention as defined in the appended claims.

Having described our invention, we now claim:

1. An anti-torpedo defense system, said system comprising in combination:

detecting means for detecting and locating an incoming threat;

missile launching means including a fire control system responsive to said detecting means for launching at least one warhead carrying missile in the path of the incoming threat, said missile having buoyancy control means for controlling the depth of said missile in a body of water, and an active fuze system including target sensing and tracking means carried by said missile for detonating the warhead at the optimum proximity of an incoming threat thereto.

2. The anti-torpedo defense system of claim 1, wherein said target sensing means comprises directional sensing means responsive to said fire control system to selectively orient toward said incoming threat.

3. The anti-torpedo defense system of claim 2, wherein said target sensing means is acoustic.

4. The anti-torpedo defense system of claim 1, wherein buoyancy control means is responsive to stabilize said missile in a vertically oriented position at a predetermined depth below the surface of a body of water.

5. The defense system of claim 1, wherein said fuze system is responsive to the position of the missile with respect to its launch position for selectively controlling the directional sensing means.

6. The defense system of claim 1, wherein said active fuze system includes a microcomputer having a memory.

7. The defense system of claim 6, wherein the fire control system is connected to feed target azimuth angle from the launching means into the microcomputer memory prior to launching of the missile.

8. The defense system of claim 3, wherein said sensing means comprise a plurality of transducers, each oriented in a different radial angle about the axis of said missile.

9. The defense system of claim 7, wherein said missile includes a warhead exploder having arming and disarming means for automatically arming said exploder upon entering the body of water.

10. The defense system of claim 9, wherein said microcomputer is responsive to a predetermined delay within which no threat enters within the optimum proximity for disarming said exploder.

11. The defense system of claim 10, wherein said microcomputer deactivates said float control after said predetermined delay for permitting said missile to sink to the bottom of the body of water.

12. The defense system of claim 1, wherein said target sensing and tracking means comprises a pulse doppler system.

13. The defense system of claim 12, wherein said doppler system includes means for generating pulses of approximately 2.0 milliseconds.

14. The defense system of claim 13, wherein said doppler system includes a pulse generator and selector means for selectively coupling said pulse generator to a selected transducer.

15. The defense system of claim 14, wherein said selector means includes transmit and receive modes for alternately transmitting pulses to and receive pulses from a selected transducer.

* * * * *